US005495084A

United States Patent [19]

Meyer et al.

[11] Patent Number: 5,495,084

[45] Date of Patent: Feb. 27, 1996

[54] SLIP-THROUGH MOUNTING STRUCTURE FOR CIRCUIT INTERRUPTER

[75] Inventors: Jeffry R. Meyer, Greensburg; Tomas B. Otterberg, Murrysville, both of Pa.

[73] Assignee: ABB Power T&D Company Inc., Blue Bell, Pa.

[21] Appl. No.: 222,840

[22] Filed: Apr. 5, 1994

[51] Int. Cl.[6] ..... H01H 33/70; H01H 33/91

[52] U.S. Cl. ..... 218/43; 218/57; 218/59; 218/68; 218/74; 218/78; 218/84

[58] Field of Search ..... 200/148 R, 148 A, 200/148 B, 144 A, 144 B, 144 AP; 218/1, 43, 48, 49, 50, 57, 58, 65, 68, 69, 74, 75, 79, 84, 118, 143–145, 146, 154, 62.85

[56] References Cited

U.S. PATENT DOCUMENTS

| | | | |
|---|---|---|---|
| 3,733,452 | 5/1973 | Strippoli et al. | 200/148 A |
| 4,095,068 | 6/1978 | Meyer et al. | 218/58 |
| 4,101,748 | 7/1978 | Meyer et al. | 218/69 |
| 4,110,578 | 8/1978 | Freeman et al. | 218/84 |
| 4,110,580 | 8/1978 | Farish | 218/85 |
| 4,131,775 | 12/1978 | Meyer et al. | 218/43 |
| 4,132,876 | 1/1979 | Sato et al. | 218/62 |
| 4,780,581 | 10/1988 | Holmgren et al. | 200/148 A |
| 5,304,762 | 4/1994 | Hiltbrunner | 200/148 A |

*Primary Examiner*—J. R. Scott
*Attorney, Agent, or Firm*—Woodcock Washburn Kurtz Mackiewicz & Norris

[57] ABSTRACT

The movable contact of a puffer interrupter contains a movable conductive tubular sleeve which is electrically connected to and is slidably mounted within a hollow conductive adapter which is supported from the end of a bushing insulator. An insulation rod flexibly connects the adapter to the housing. A pair of flexible rods connect the end of the interrupter to the end of the housing. The puffer interrupter is mounted within a dead tank housing.

13 Claims, 7 Drawing Sheets

PRIOR ART

INCOMING CURRENT
OUTGOING CURRENT
STATIONARY CONTACT ASSEMBLY
TRANSFER CONTACTS
MOVING CYLINDER
STATIONARY PISTON ASSEMBLY
MAIN CONTACTS
PARTICLE TRAP GROOVE AND GUIDE BEARING
40
43
55
56
60
61
62
65
70
79
80
81
85
89
90
90a
90b
92
95
96
97
53
54
134
135

SLIP-THROUGH MOUNTING STRUCTURE FOR CIRCUIT INTERRUPTER

BACKGROUND OF THE INVENTION

This invention relates to circuit interrupters, and more specifically relates to a circuit breaker having an interrupter assembly which is slidably connected within a gas-filled circuit breaker housing to one end of a bushing insulator conductor.

Circuit breakers using puffer type interrupter units are well known. Such puffer interrupters are elongated units having movable and stationary contact assemblies which are connected, respectively, to the ends of the insulator bushing conductors. The space between the bushing conductor ends is relatively long, and must include the full length of the stroke of the movable contact. Moreover, the movable and stationary contact assemblies must be made with close tolerances to enable their cooperation within the circuit breaker tank. It is also difficult and tedious to mount and remove the interrupters from their enclosure.

SUMMARY OF THE INVENTION

In accordance with the invention, a circuit breaker puffer interrupter geometry is provided which improves overall conductivity, minimizes bushing insulator spacing, maximizes allowable manufacturing tolerances, is self-guided and is easily installed and removed.

More specifically, the movable tubular conductive sleeve of a movable puffer interrupter is slidably mounted within a conductive support extending from one end of one of the bushing insulators. The stationary contact is mounted from the main support tank and is connected to the other bushing insulator for a particular phase. An insulation rod also fixes the slidable conductive support to the housing to minimize lateral stress on the bushing conductor.

During operation, the conductive moving sleeve moves between its open and closed contact positions relative to the end of the bushing conductor from which it is supported. Consequently, the conductive path through the interrupter is reduced in length, thus reducing the resistance of the path and decreasing heat generation within the circuit breaker housing. Further, the slidable mounting of the conductive sleeve permits self-guided monitoring of the movable assembly of the interrupter, thus maximizing manufacturing tolerances and simplifying the installation and removal of the interrupter.

Other features and advantages of the present invention will become apparent from the following description of the invention which refers to the accompanying drawings.

DETAILED DESCRIPTION OF THE INVENTION

Figures 1, 2:
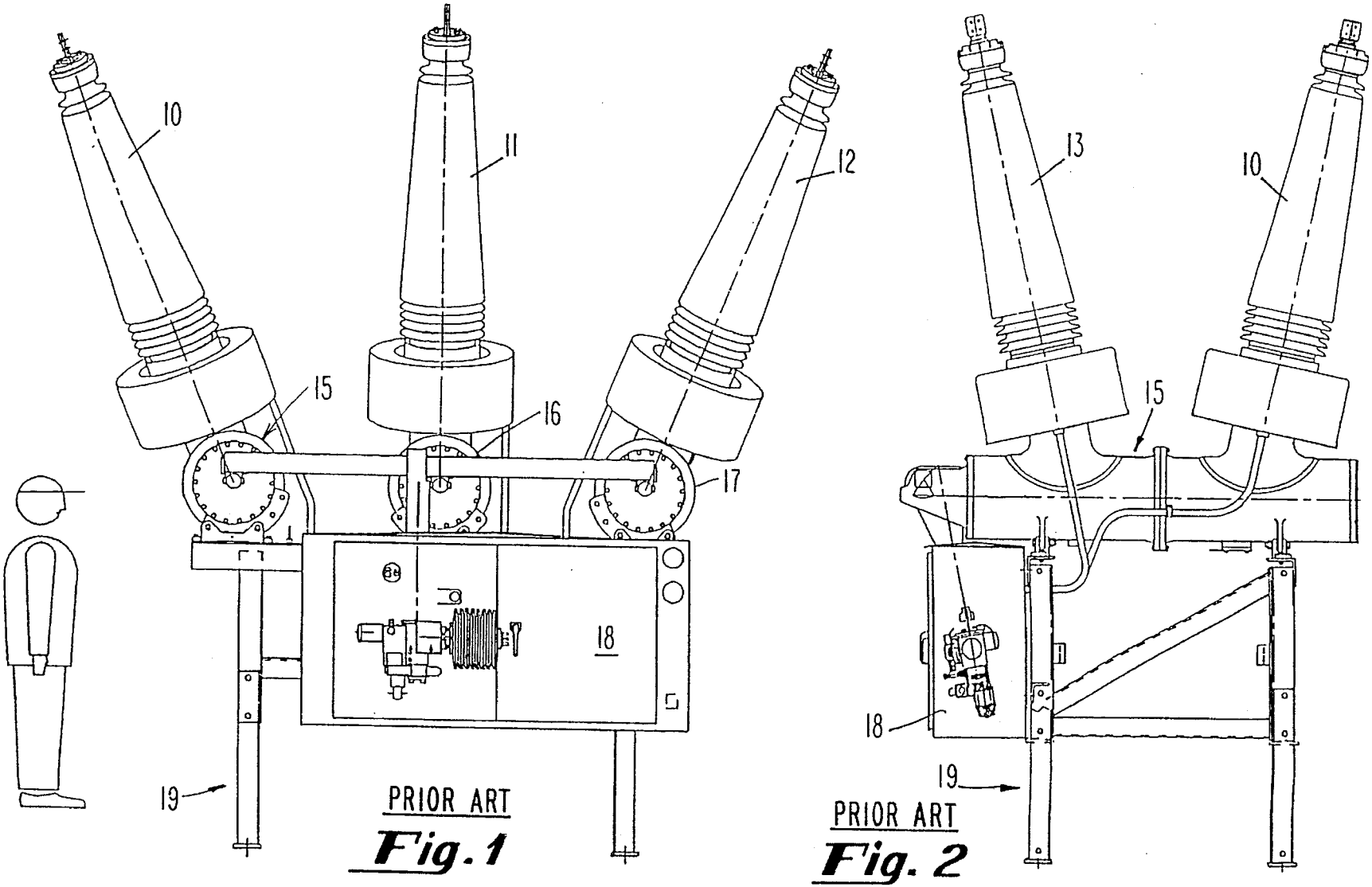
Fig. 1 PRIOR ART
FIG. 1 is an elevational view of a prior art three-pole circuit breaker employing gas puffer type interrupters.
FIG. 2 is a side view of the circuit breaker of FIG. 1.
Figure 3:
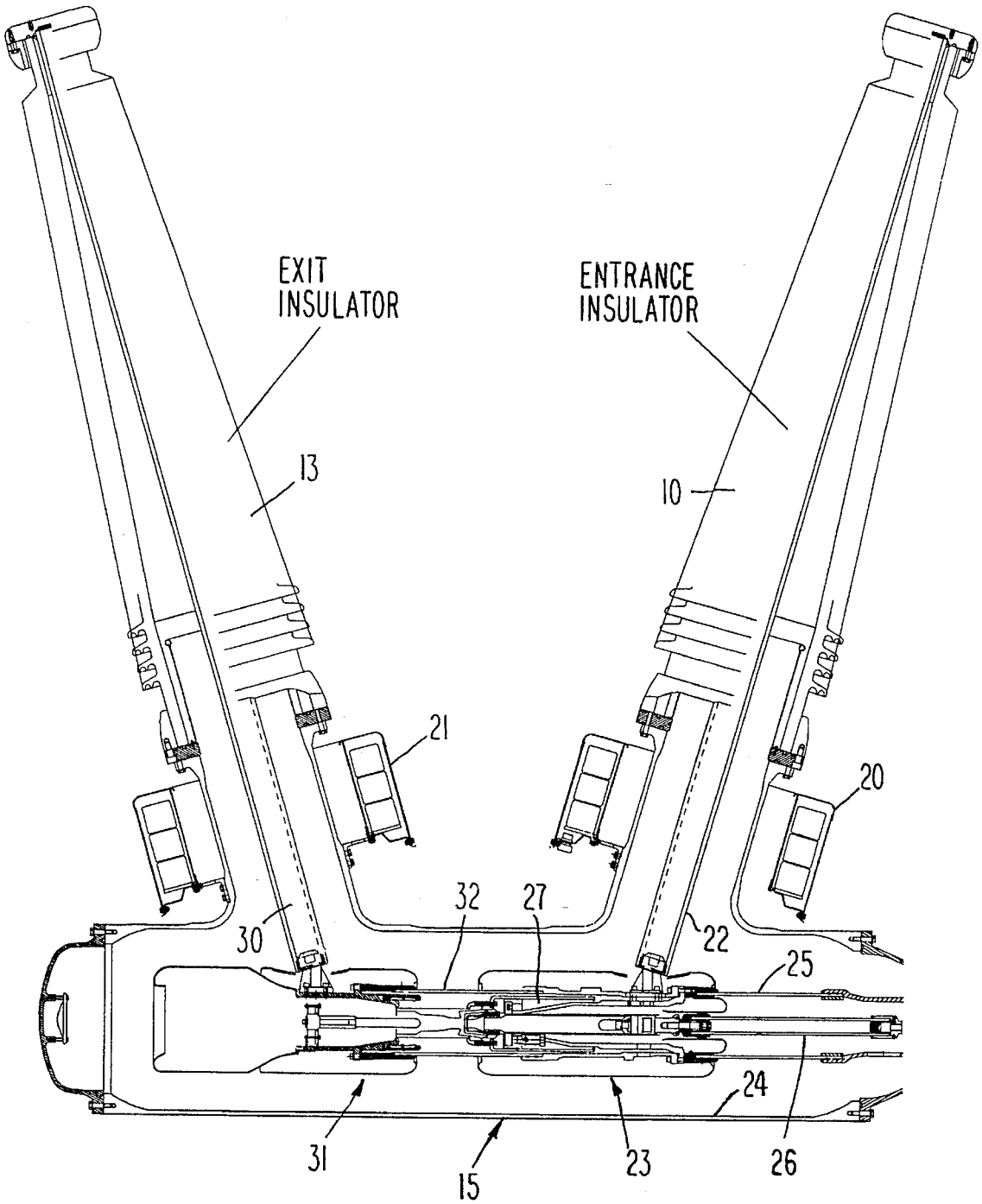
PRIOR ART Fig. 3
FIG. 3 is a partial cross-sectional view and partial schematic view of one pole unit of FIGS. 1 and 2.

A prior art circuit breaker, employing puffer interrupters, is shown in FIGS. 1, 2 and 3. FIGS. 1 and 2 show a three-pole circuit breaker having entrance bushing insulators 10, 11 and 12 for each respective phase (FIG. 1) and three corresponding exit bushing insulators of which only one, bushing 13, is shown in FIG. 2. The circuit breaker is a dead tank circuit breaker, and has three horizontal puffer interrupter assemblies 15, 16 and 17 (FIG. 1), each of which is associated with a corresponding pair of exit and entrance bushings. The interrupter assemblies, bushings and an operating mechanism 18, which simultaneously operates each of the interrupters, are mounted on a frame mounting 19, shown in FIGS. 1 and 2.

FIG. 3 is a view, partly in cross-section, of interrupter 15 and bushings 10 and 13 of FIGS. 2 and 3. Bushings 10 and 13 have current transformers 20 and 21, respectively. Entrance bushing 10 has a central conductor 22 which supports the interrupter assembly 23 within conductive tank 24. The right-hand end of assembly 23 is fixed to an insulator tube 25, through which a linearly movable operating rod 26 extends, which operates movable contact 27 between its open and closed positions, in the well-known manner.

Exit insulator 13 has a central conductor 30 which is connected to the stationary contact assembly 31 which is suitably supported within tank 24. An insulator tube 32 extends between the stationary and movable contact assemblies 31 and 23, respectively.

The interior volume of tank 24 and insulators 10 and 13 is filled with a dielectric gas, such sulfur hexafluoride ($SF_6$) at ambient pressure. During operation of the contacts of interrupter assemblies 23 and 31, a piston which moves with the movable contact compresses the $SF_6$ gas and forces it through the arc drawn between the separating contacts to cool and extinguish the arc. The gas also acts to provide an excellent insulator between the conductive parts within housing 15 and the wall of tank 24.

SLIP THROUGH INTERRUPTER STRUCTURE

Figure 4:
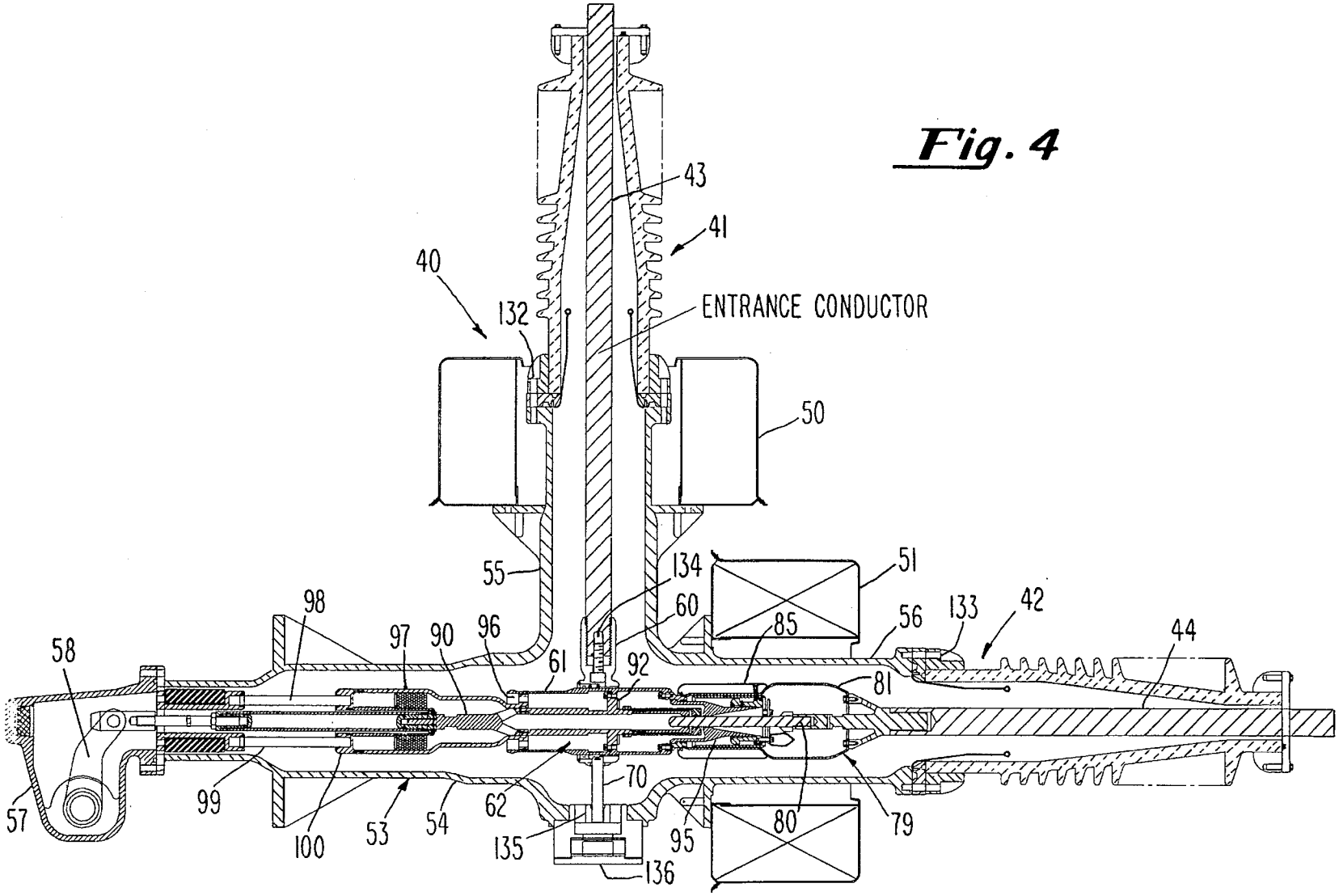
FIG. 4 is a partial cross sectional and partial schematic view of a novel interrupter assembly in which the interrupter is slidably mounted within an adapter assembly supported at one end of an entrance conductor.
Figure 5:
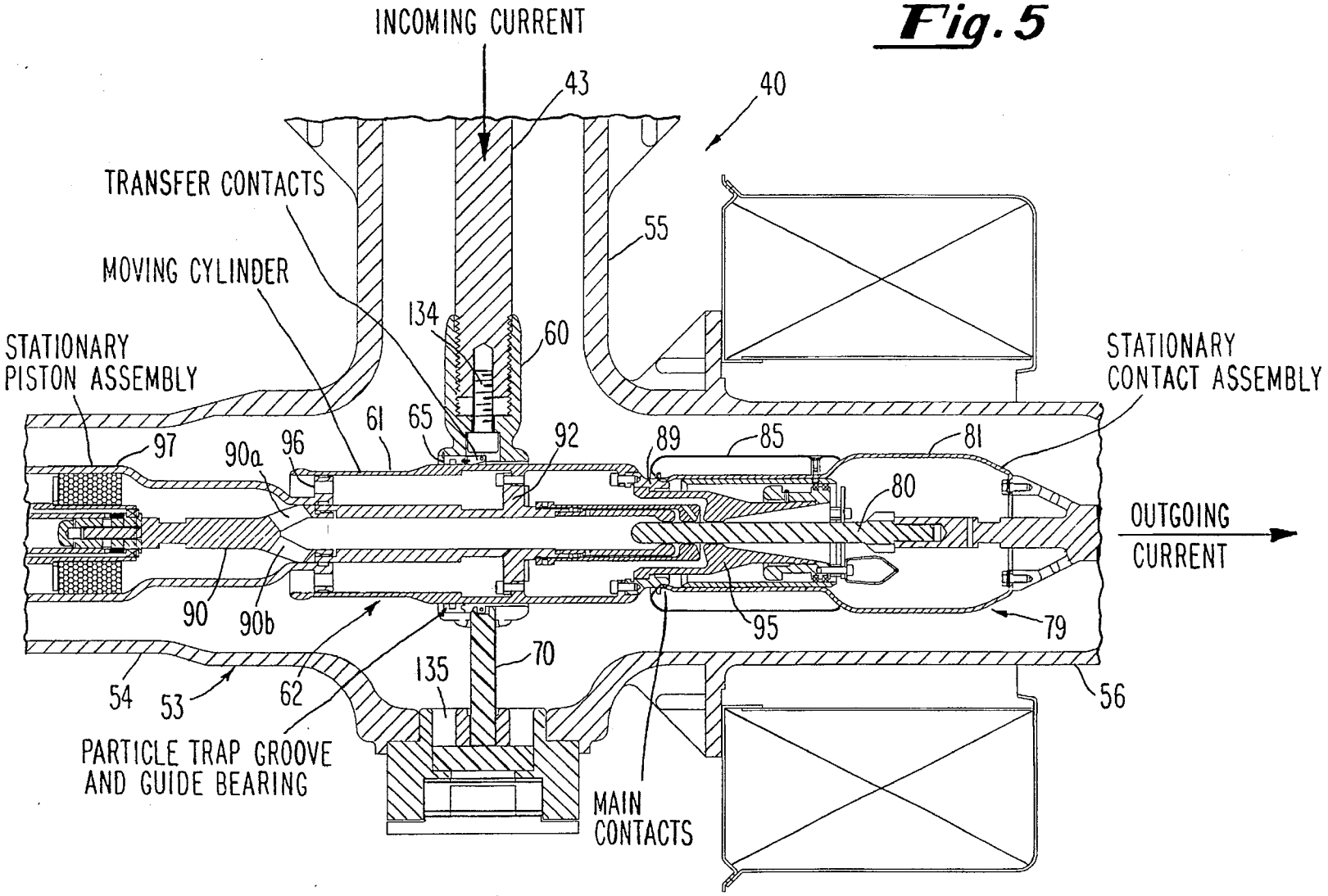
FIG. 5 is an enlarged view of portions of FIG. 4, to highlight the structure of the slip-through interrupter mounting.
Figure 6:
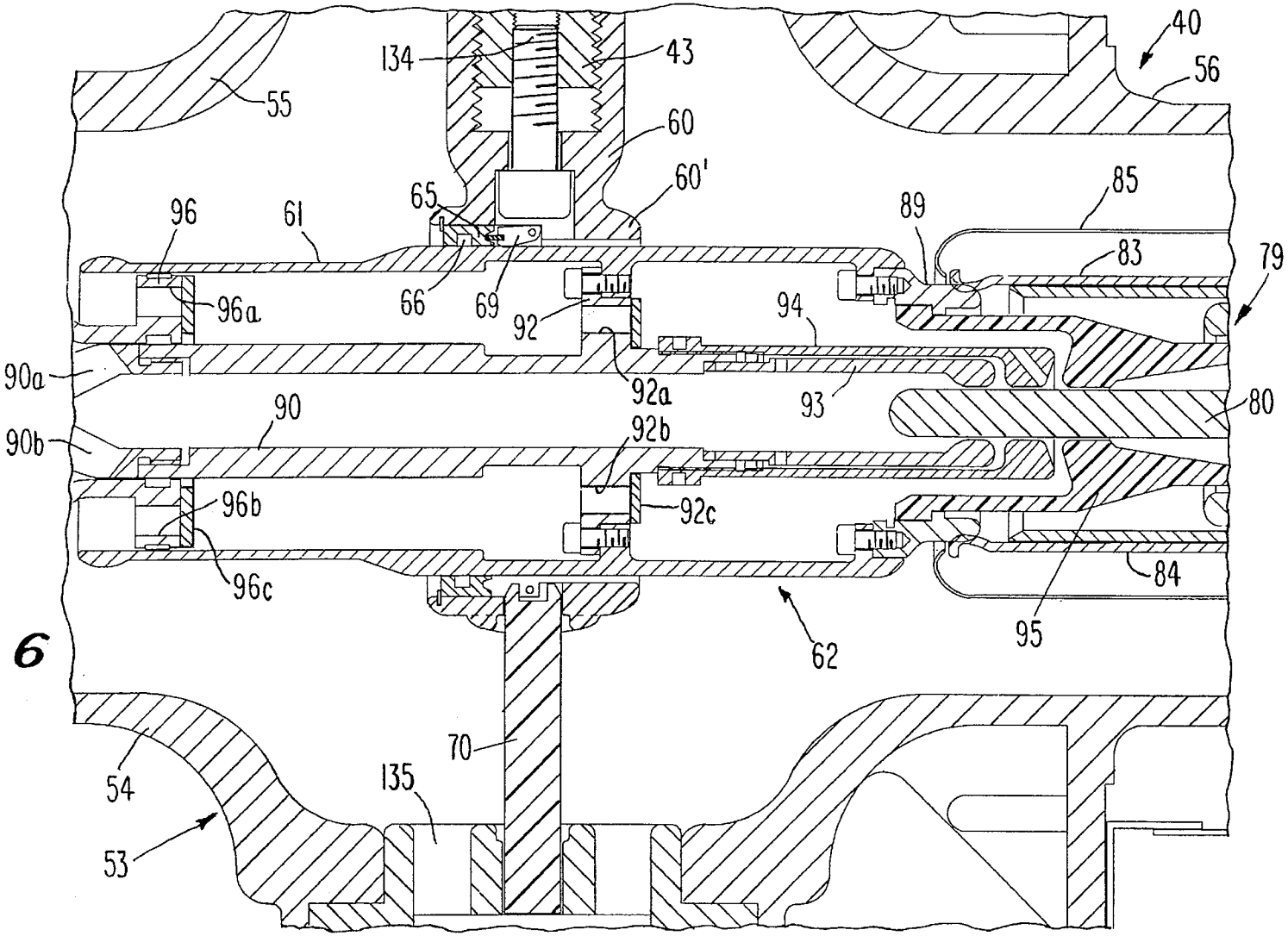
FIG. 6 is a further enlargement of FIG. 5 to further display the novel slip-through feature of the interrupter assembly.

There is next described, particularly with respect to FIGS. 4, 5 and 6, the novel "slip-through" mounting for the interrupter structure which simplifies the installation and removal of the interrupter from the housing and which improves the overall conductivity of the interrupter, minimizes bushing insulator spacing and maximizes manufacturing tolerances.

In the prior art interrupters of FIGS. 1, 2 and 3, relatively long support insulators 10 and 13 are required and they must be carefully aligned to permit low friction motion for thee interrupter during its operation. The current path between the ends of the bushing conductors 22 and 30 is also necessarily relatively long, resulting in higher electrical resistance in the path and thus higher temperature rises, limiting the continuous current carrying ability of a given size interrupter.

The novel interrupter support structure shown in FIGS. 4, 5 and 6 improves these undesired features of the prior art interrupter of FIGS. 1, 2 and 3.

FIGS. 4, 5 and 6 show one pole 40 of an interrupter structure and its internal structure. The pole has a vertically disposed entrance insulator 41 and a horizontally disposed exit insulator 42, which have entrance and exit conductors 43 and 44, respectively. The tank entrances at insulators 41 and 42 are also provided with current transformers 50 and 51, respectively, as shown.

A metal support tank 53 has a horizontal body portion 54, a vertical tubular portion 55 and a horizontal tubular portion 56. Insulators 41 and 42 are bolted to the ends of tank portions 55 and 56, respectively, with bolts as shown at 132 and 133. Tank 53 is filled with $SF_6$ at a pressure, for example, of about 4 atmospheres.

An operating mechanism housing 57 (FIG. 4) contains an operating lever 58 for operating the interrupter contacts to be described.

In accordance with an important feature of the novel structure of FIGS. 4, 5 and 6, a hollow conductive adapter 60 is bolted with bolt 134 to the end of entrance conductor 43 and has a conductive ring portion 60' which surrounds and slidably supports the moving conductive cylinder or sleeve 61 of the interrupter moving contact assembly 62.

A ring-shaped guide bearing 65 (FIG. 6) is contained within the inner diameter of hollow adapter 60 and ensures low friction sliding of the moving cylinder 61 along its axis and along the axis of tank 54, and reduces the generation of conductive particles. A ring-shaped groove 66 (FIG. 6) acts as a particle trap or low field region in which conductive particles will remain trapped once reaching the groove 66. Current is transferred from adapter 60 to conductive sleeve 61 by a plurality of suitable sliding transfer contacts 69 (FIG. 6) which encircle the sleeve 61.

A plastic insulation rod adapter 70, which is mounted on the inside wall of housing 54 is connected to the adapter 60 to provide added lateral support to the adapter 70. The upper end of rod 70 is connected by a slide fit to an opening in adapter 60. The bottom of rod 70 is glued, or otherwise fixed, to an opening 135 or a bolted accessory such as a gas relief device 136 to limit overpressure in tank 53. Adapter 60 limits the bending motion of the entrance conductor 43 which might be caused by side loads during sliding movement of the interrupter moving cylinder 61.

The stationary contact assembly 79 in FIGS. 4, 5 and 6 is connected to and supported from the end of exit conductor 44 and includes stationary arcing contact rod 80, a conductive enlarged housing 81 (FIGS. 4, 5 and 7), and stationary contact fingers, including flexible fingers 83 and 84 (FIG. 6). A conductive electrostatic shield 85 encloses contact fingers 83–84.

Figure 7:
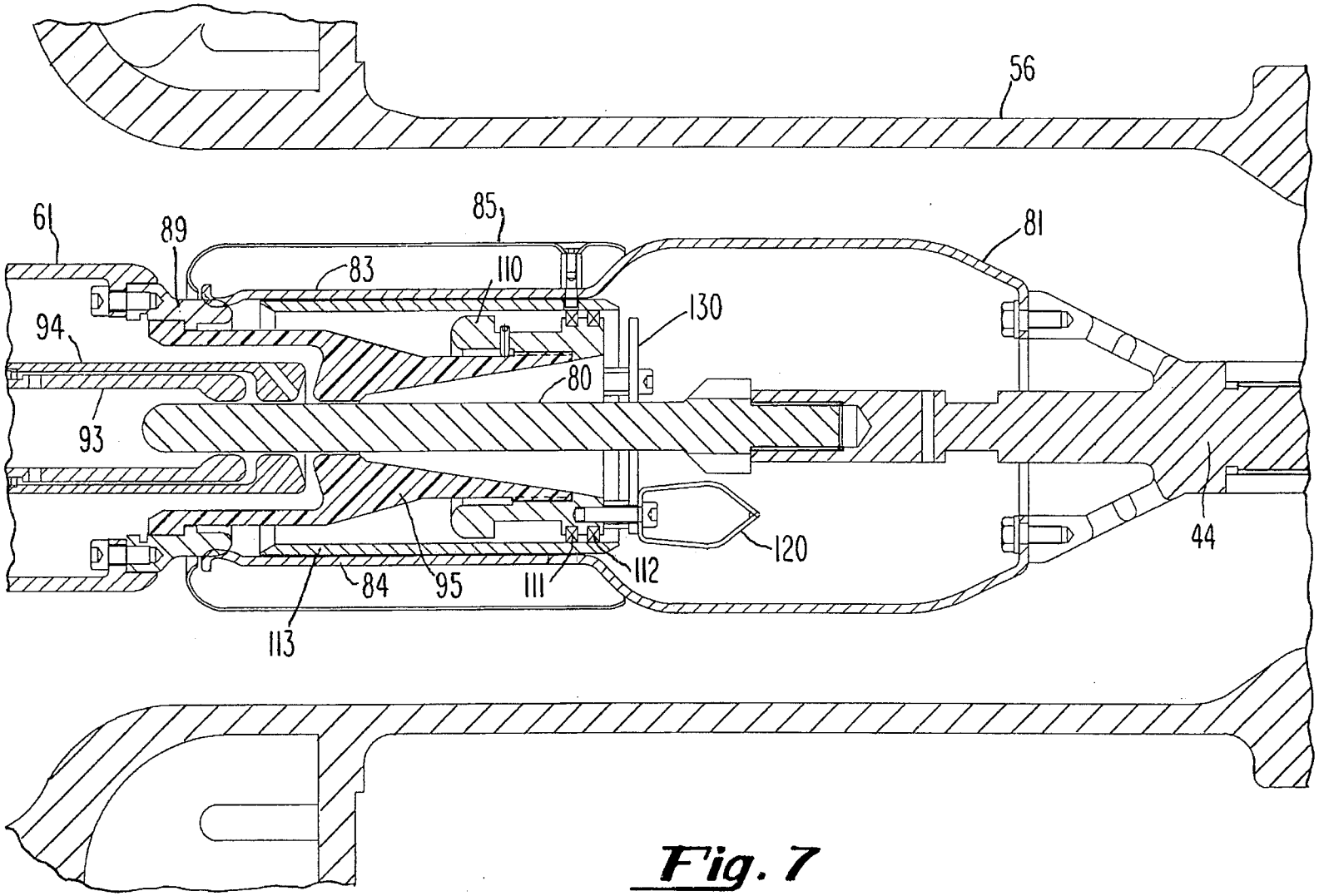
FIG. 7 is a cross-section, similar to that of FIG. 6, but emphasizing the structure of a novel gas mixing plate fixed to the moving baffle.

The movable contact assembly in FIGS. 4, 5 and 6 includes the movable conductive cylinder 61, main contact ring 89, movable operating rod 90, connected to cylinder 61 by flange 92, the movable arcing contact fingers 93 and 94, and insulation nozzle 95. Operating rod 90 has radial openings therethrough, such as openings **90*a* and 90*b*. A stationary piston 96 is held in the annular space between axially movable rod 90 and sleeve 61 during device operation, as shown in FIGS. 5–7. Piston 96 is fixed to piston support assembly 97 which, in turn, is supported from small, flexible insulation support rods 98 and 99 (FIG. 4) which are connected from the end of housing 54 to openings within ring 100 at the end of assembly 97**.

Support rods 98 and 99 are sufficiently flexible to permit the interrupter assembly to move up and down slightly as operating mechanism lever 58 rotates to move the contacts 83 and 89 and 80 and 93 between their engaged and disengaged positions.

Stationary piston 96 has a plurality of axially directed openings **96*a* and 96*b* therethrough which are closed by an appropriate spring biased valve plate 96*c*. Similarly, flange 92 has a plurality of openings 92*a*, 92*b* which are closed by an appropriately spring biased plate 92*c*. The springs biasing valve plate 96C and plate 92C** are not shown in the drawings.

When the interrupter is closed, as shown in FIGS. 6 and 7, a current path extends from entrance conductor 43, adapter 60, transfer contacts 69, moving conductive cylinder or sleeve 61, main contact ring 89, stationary contacts 83–84, housing 81 and exit conductor 44.

To open the interrupter, operating rod 90 is moved to the left, and the conductive cylinder 61, also moves left. Contact ring 89 disconnects from contacts 83 and 84 and, subsequently, an arc is drawn between arcing contact 93 and stationary arcing contact rod 80.

As cylinder 61 moves to the left, insulation nozzle 95 also moves to the left. The gas trapped between the stationary piston 96 and the moving cylinder 81 is compressed and flows through flow holes **90*a* and 90*b* in rod 90, and through the interior of assembly 62** and into and through the arc region.

Since adapter 60 supports the interrupter assembly 62, the entire assembly floats with and is guided by adapter 60, allowing the insulating supports 70, 98 and 99 to ground to be very small and flexible. The main support for the entire interrupter is provided by the entrance and exit insulators 41 and 42. Furthermore, manufacturing tolerances are large because of the self-guiding characteristics of the design. That is, the support structure allows centering and alignment of relatively out-of-tolerance parts without wear or high friction during operation.

This novel geometry eliminates the need for large and expensive insulators to support the stationary piston assembly 97 and across the interrupter gap region. The laterally flexible stationary contact assembly is guided and supported by the main nozzle 95 that bridges the gap. The result is a simpler assembly with fewer parts and a better usage of the interrupting gas within the tank. This gas is used for electrical insulation of the high voltage parts from the ground potential of the tank wall and the gas is also used for interruption of the arcs generated in the circuit breaker during its operation. The ideal situation is to have all of the gas cycled through the interrupter as it repeatedly operates to keep the gas in the interruption region cool and relatively pure. The novel design shown in FIGS. 4, 5 and 6 largely achieves this goal by elimination of any insulation support that tends to block free gas flow throughout the tank interior. Less total gas can then be used.

The assembly of the circuit breaker is simplified because the entire assembled interrupter, the entrance insulator assembly 41, and the exit insulator assembly 44 are fully assembled outside of the tank 53 as sub-assemblies. They are then simply inserted into the tank 53 with no required adjustments or assembly inside the tank. This reduces required labor and allows a small tank to be used because there is no need to work inside the tank 53.

This geometry also allows the current transfer length in the interrupter to be very short compared to designs now in use. Also, the main contacts 89 are all on relatively large diameters because they are on the outside diameter of the components instead of the inside. This reduces the resistance of the current path, reduces the temperature rise of the parts, and allows smaller parts for a given rated current. This geometry also shortens the entire circuit breaker pole assembly by allowing the insulators (or bushings) to be closer together. A 90° arrangement is shown because this is the optimum geometry to minimize tank length and number of parts. Other entrance geometries are possible.

SHIELD RING ON MAIN NOZZLE

FIG. 7 shows the interrupter of FIG. 6 and the same identifying numeral identifies the same parts. FIG. 7 shows a shield ring 110 which is fixed to the downstream end of nozzle 95. Shield ring 110 is electrically connected to the ring of stationary contacts 83–84 by spring or flexible wire 120 which makes sliding contact with conductive cylinder 113 at mid-stroke through the full open position of the contacts 83–84 and 89. Also shown in FIG. 7 are sliding low friction guides/seals 111 and 112 which contact conductive cylinder 113, which is connected to contact fingers 83–84. When the contacts open, the field stress in the open interruption gap will be applied between movable contact 89 which has a ring shape and shield 110. This will lower the electrical stress in the gap after it is more than about ½ open.

More specifically, lowering electrical stress in the open gap region allows smaller components to be used and can provide greater design margins. This applies to the arc interruption and to the dielectric withstand of the gap after interruption is completed. However, there are limits to this stress reduction process when the several other geometric requirements of an interrupter are met also.

An improvement on these limits is possible by providing the conductive shield 110 which moves with the main interrupter nozzle 95 and is electrically attached to the stationary contact assembly. The shield 110 provides an improved electrical shape in the gap region when the interrupter is more than ½ open. The improvement increases until the interrupter is fully open. This geometry also allows the moving cylinder 61 and the stationary finger contacts 83–84 to be of larger diameter than would otherwise be possible, a desirable condition for current transfer and internal interrupter gas volume. The ultimate effect is to allow reduction in the overall interrupter size for a given voltage rating without sacrificing the dielectric withstand capability.

The electrical connection to the stationary side can be accomplished several ways. FIG. 7 shows a preferred method, i.e., use of the flexible wire 120 which will slidably contact cylinder 113 when the contacts 83, 84 and 89 open. This electrical connection is important to keep the shield 110 at the same electrical potential as the stationary contacts. This eliminates any possibility of local arcing at the shield-stationary contact interface and improves the effectiveness of the moving shield 110.

This improvement can be used at any voltage or interruption current rating. Preferably, the shield is made from aluminum to minimize weight but other metallic materials are possible.

Figure 8:
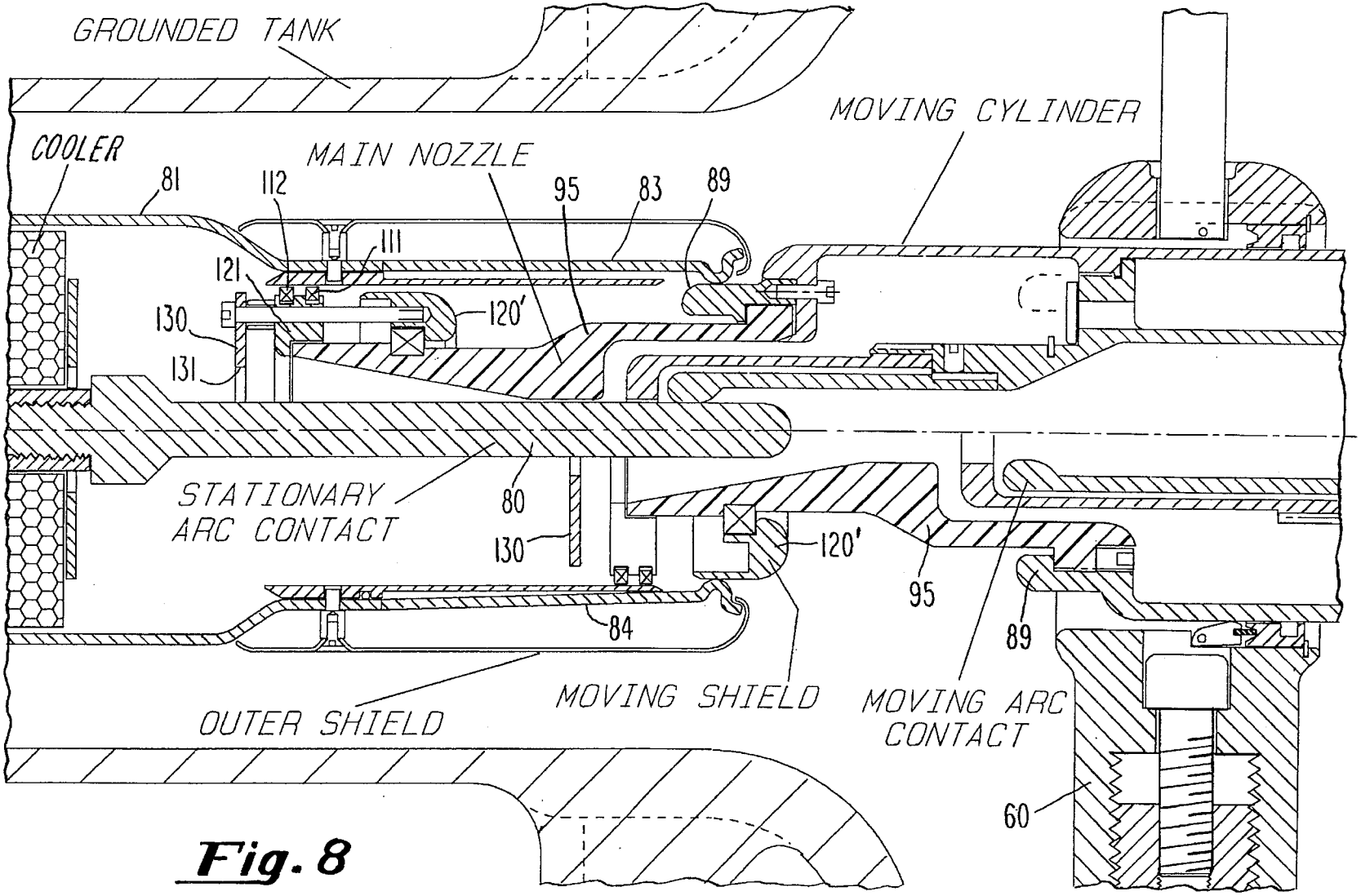
FIG. 8 is a view, similar to that of FIGS. 6 and 7, further emphasizing a novel moving electrostatic shield structure secured to the movable baffle and showing the interrupter gap in an open position above the contact center line, and in the closed position below the contact center line.

Another version of the shield is shown in FIG. 8 as two part shield 120'–121 where shield portion 121 contains the sliding guides/seals 111–112. The lower half of FIG. 8 shows the shielded fully open gap which improves electrical stress across the open gap. The shield 120' makes contact with the main current contacts 83, 84 during approximately the last 30% of its motion and, in doing so, the shield 120' has the same voltage as the main contacts 83, 84 thereby effecting its shielding function.

MOVING GAS MIXING PLATE

FIGS. 7 and 8 show a novel mixing plate 130 spaced from and bolted to the moving shield 110/120' and movable with baffle 95. Plate 130 is preferably a round disk which may or may not have a central opening 131, as in FIG. 8. Plate 130 is of any high temperature resistant material, for example, steel. Plate 130 has the function of causing hot gas from the interruption gap during circuit interruption to flow turbulently into the mixing volume within housing 81 to mix with cool gas, before the gas reaches other areas within the interrupter housing which is subject to high voltage stress. More specifically, the arc is generated in the breaker interrupter during opening and successful interruption of the current flow depends largely upon a rapid flow of cool gas ($SF_6$) through the arc. The heated gas leaving the interrupter main gap area, coming out of the main nozzle 95, must be cooled before it is allowed to flow into a region of voltage stress. This cooling is often accomplished by the use of a stationary mixing plate, the hot gas forcing past and around the plate becoming a turbulent flow and causing good mixing with cooler gas in its path. This operation requires a relatively large volume of cool gas in the flow path that is inside the main interrupter body 53. A large, unused volume is thus needed that generally serves no other purpose.

The mixing plate of the invention permits use of a smaller gas volume, and thus a smaller interrupter structure.

In operation, the main nozzle 95 and plate 130 move with the interrupter cylinder 61 as it is opened. Therefore, a significant volume is vacated by the nozzle assembly into which cool gas will be drawn. The heated gas from the arc region will begin to flow out of the nozzle from the mid-stroke of the interrupter and will mix with the now larger cool gas volume created. Turbulent mixing will be improved because the cool gas is already in motion due to the drawing-in action and mixing will be more complete. This reduces surface erosion of parts of the interrupter interior, caused by the flow of the hot gas if not cooled evenly and quickly.

The assembly of the interrupter with a moving plate 130 is also easier than one using a stationary plate design. The moving plate 130 attaches directly to the moving nozzle assembly 95 which is assembled on a bench in production or, during field maintenance. A stationary plate is often attached deep in the interrupter, difficult to access, inspect, and replace.

The plate shape is usually of a round disk, with or without a center hole, and is sized to obtain the correct flow and turbulence. Other shapes are possible depending upon the specific interrupter design and gas flow requirements.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A circuit breaker comprising, in combination: an elongated hollow housing; a first and a second bushing insulator and a circuit interrupter; said circuit interrupter being mounted within said housing; said first and second bushing insulators being mounted to said housing; said bushing insulators each comprising a central elongated conductor and an insulation cylinder coaxially surrounding its said central conductor; said circuit interrupter comprising a stationary contact assembly and a movable contact assembly which are relatively movable between open and closed positions; said movable contact assembly having a movable cylindrical tubular sleeve movable along its central axis; one of said elongated conductors having an adapter fixed to its free end for slidably supporting said movable sleeve and for making sliding electrical contact to said sleeve; said adapter being directly connected to said one of said elongated conductors and providing an electrical path between said one of said elongated conductors and one of said stationary and movable contact assemblies and, an insulation rod support connected between one portion of said adapter and one portion of said housing, said stationary contact assembly being fixedly supported within said elongated hollow housing.

2. The circuit breaker of claim 1 wherein said adapter has a hollow ring-shaped support region having an axis which is coaxial with said elongated housing.

3. The circuit breaker of claim 2 wherein said interrupter is a puffer interrupter.

4. The circuit breaker of claim 3 wherein the axes of said bushing conductors are at 90° to one another and are in a common plane.

5. The circuit breaker of claim 1 wherein the axes of said bushing conductors are at 90° to one another and are in a common plane.

6. The circuit breaker of claim 5 wherein said adapter has a hollow ring-shaped support region having an axis which is coaxial with said elongated housing.

7. The circuit breaker of claim 6 which further includes an insulation support rod connected between one portion of said adapter and one portion of said housing.

8. The circuit breaker of claim 1 wherein said interrupter is a puffer interrupter.

9. The circuit breaker of claim 8 wherein said housing is filled with $SF_6$ gas; said $SF_6$ gas being free to flow throughout the full length of said housing.

10. The circuit breaker of claim 8 wherein said adapter has a hollow ring-shaped support region having an axis which is coaxial with said elongated housing.

11. The circuit breaker of claim 1 which further includes a volume of insulation gas within said housing, a stationary piston having one end thereof fixed to one end of said elongated hollow housing and a movable cylinder means fixed to said movable contact assembly and movable relative to said stationary piston to compress a volume of said insulation gas during the opening of said fixed and movable contact assemblies and to force gas flow through the arc interruption area between the opening contacts.

12. The circuit breaker of claim 11 which includes at least two thin, elongated flexible rods for connecting said stationary piston assembly to said housing, whereby said piston assembly is free to translate perpendicular to its axis during movement of said movable contact assembly, and whereby the gas in the volume of said housing which occupies said flexible rods can circulate along the axis of said housing during movement of said movable contact assembly.

13. The circuit breaker of claim 11 wherein said adapter has a hollow ring-shaped support region having an axis which is coaxial with said elongated housing.

* * * * *

UNITED STATES PATENT AND TRADEMARK OFFICE

CERTIFICATE OF CORRECTION

PATENT NO. : 5,495,084

DATED : February 27, 1996

INVENTOR(S) : Jeffry R. Meyer et al.

It is certified that error appears in the above-identified patent and that said Letters Patent is hereby corrected as shown below:

At column 2, line 67, "thee" should be --the--

At column 4, line 31, "moving cylinder 81" should be --moving cylinder 61--

Signed and Sealed this

Twenty-fifth Day of November, 1997

*Attest:*

Bruce Lehman

BRUCE LEHMAN

*Attesting Officer*

*Commissioner of Patents and Trademarks*